United States Patent [19]

Thomsen

[11] Patent Number: 4,865,091

[45] Date of Patent: Sep. 12, 1989

[54] BAG FILLING MACHINE WITH SIDE-TO-SIDE ADJUSTMENT

[76] Inventor: Peter N. Thomsen, 138 Baumont Ave., San Francisco, Calif. 94118

[21] Appl. No.: 281,986

[22] Filed: Dec. 9, 1988

[51] Int. Cl.[4] ..... B65B 3/04; B65B 43/42

[52] U.S. Cl. ..... 141/177; 53/250; 53/300; 53/381 A; 141/114; 141/165

[58] Field of Search ..... 141/10, 313, 314; 53/250

[56] References Cited

U.S. PATENT DOCUMENTS

| | | | |
|---|---|---|---|
| 4,297,929 | 11/1981 | Schieser et al. | 53/300 X |
| 4,386,636 | 6/1983 | Ellert | 141/10 |
| 4,510,737 | 4/1985 | Ellert | 53/570 |
| 4,574,559 | 3/1986 | Rutter et al. | 53/381 A |
| 4,620,411 | 11/1986 | Schiesser et al. | 53/570 |
| 4,676,285 | 6/1987 | Schiesser et al. | 141/114 |

*Primary Examiner*—Ernest G. Cusick

*Attorney, Agent, or Firm*—Phillips, Moore, Lempio & Finley

[57] ABSTRACT

A bag filling machine is adapted to fill a plastic bag with a liquid product through a gland secured to the bag. A carriage assembly is mounted on a stationary frame of the machine and comprises a conveyor for moving the bag along a path to a filling station, including a fill tube adapted for alignment with the gland to fill the bag with the liquid product. The carriage assembly is adjustably mounted on the frame whereby the carriage assembly, along with the conveyor and filling station, can be moved side-to-side on the frame to accommodate bags having their glands disposed at varied preset positions thereon.

13 Claims, 3 Drawing Sheets

BAG FILLING MACHINE WITH SIDE-TO-SIDE ADJUSTMENT

TECHNICAL FIELD

This invention relates generally to a bag filling machine used for liquid packaging systems and more particularly to a carriage assembly, having working stations of the machine mounted thereon, adjustably mounted on a stationary frame to accommodate bags having filling glands positioned at varied preset positions thereon.

BACKGROUND OF THE INVENTION

Liquid filling and packaging machines are adapted to fill plastic bags with a liquid product, such as milk, wine or fruit juices. Each bag has a gland secured thereon for the purpose of filling the bag with a liquid product from a fill tube at a filling station of the machine. Heretofore, packaging machines of this type were only adapted to accommodate bags having their filling glands at a single preset location thereon. When the preset position of the filling gland varied from the norm, a different machine was required for packaging purposes. Alternatively, drastic structural modifications to a machine were required to accommodate the same.

SUMMARY OF THE INVENTION

An object of this invention is to provide an improved bag filling machine wherein working stations thereof can be expeditiously adjusted to accommodate bags having their filling glands or fill openings disposed at varied preset positions thereon.

The bag filling machine of this invention comprises a stationary frame disposed on a longitudinal axis thereof and a carriage assembly mounted on the frame. A conveyor means is mounted on the carriage assembly for moving a bag along a path in the direction of the longitudinal axis of the machine with the bag including a fill opening positioned at a preset position on the bag for having a liquid dispensed therethrough. A filling station, including a fill tube aligned with the path of movement of the bag, it also mounted on the carriage assembly for receiving the bag and filling it with the liquid product. Adjustment means are provided for adjustably mounting the carriage assembly on the frame for selectively moving the carriage assembly, along with the conveyor means and filling station, transversely relative to the a longitudinal axis of the machine. Thus, the carriage assembly can be adjusted expeditiously and efficiently to accommodate bags having their fill openings disposed at varied preset positions thereon.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
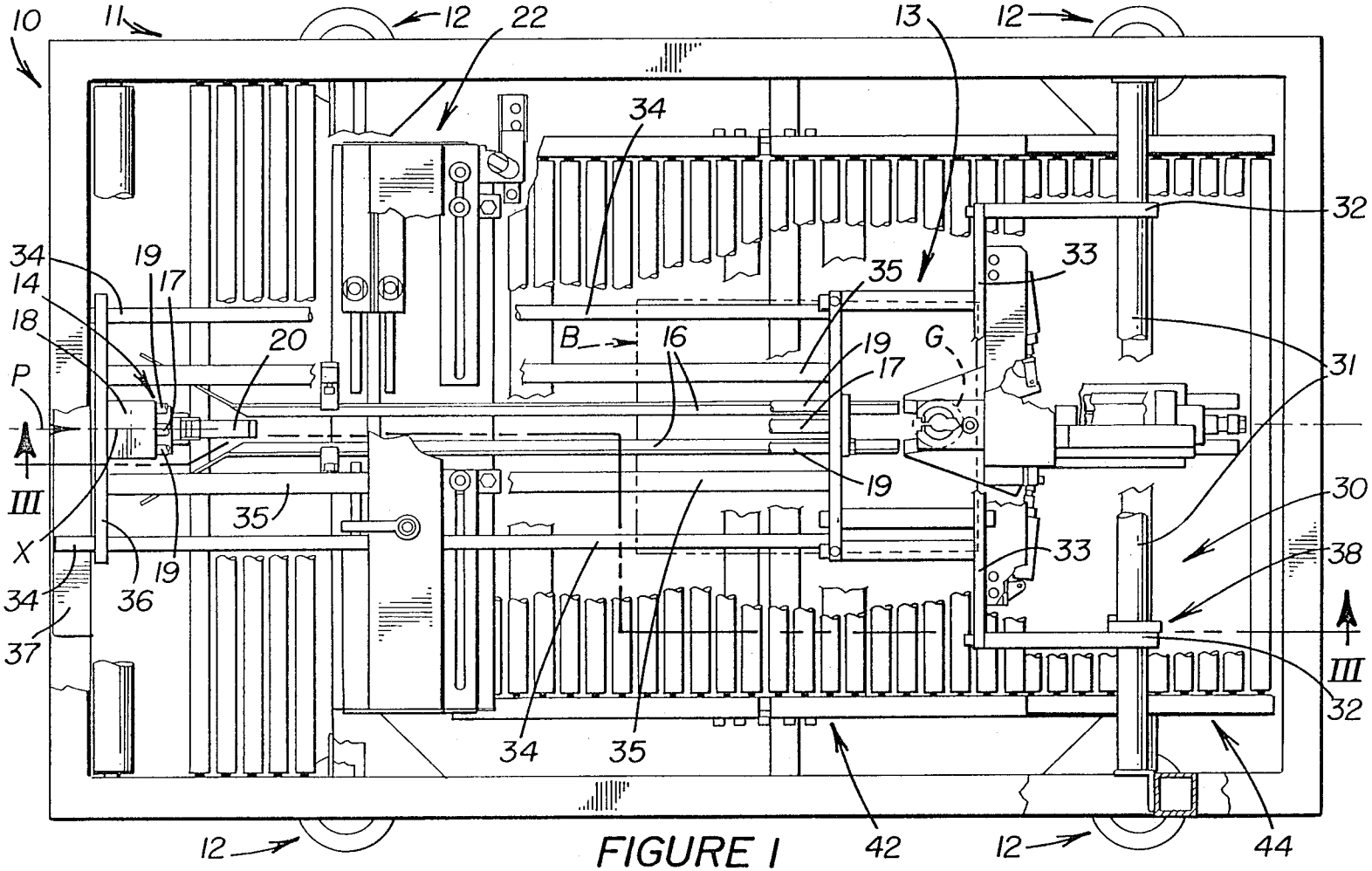
FIG. 1 is a partially sectioned top plan view of a bag embodying this invention and showing an adjustable carriage assembly thereof mounted at a first position on a frame of the machine.
Figure 2:
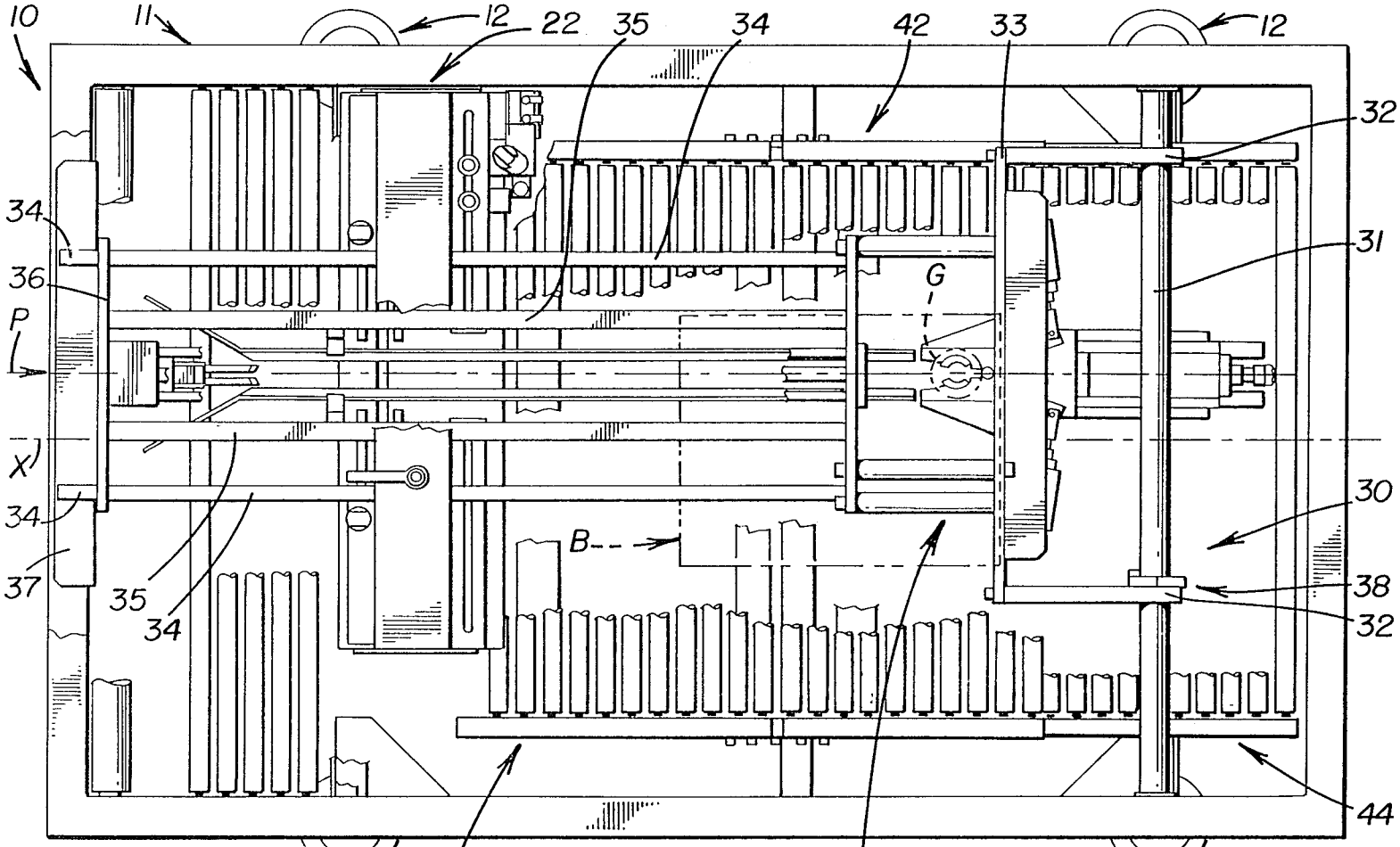
FIG. 2 is a view similar to FIG. 1, but illustrates lateral shifting and adjustment of the carriage assembly on a frame to a second position thereon.
Figures 3, 4:
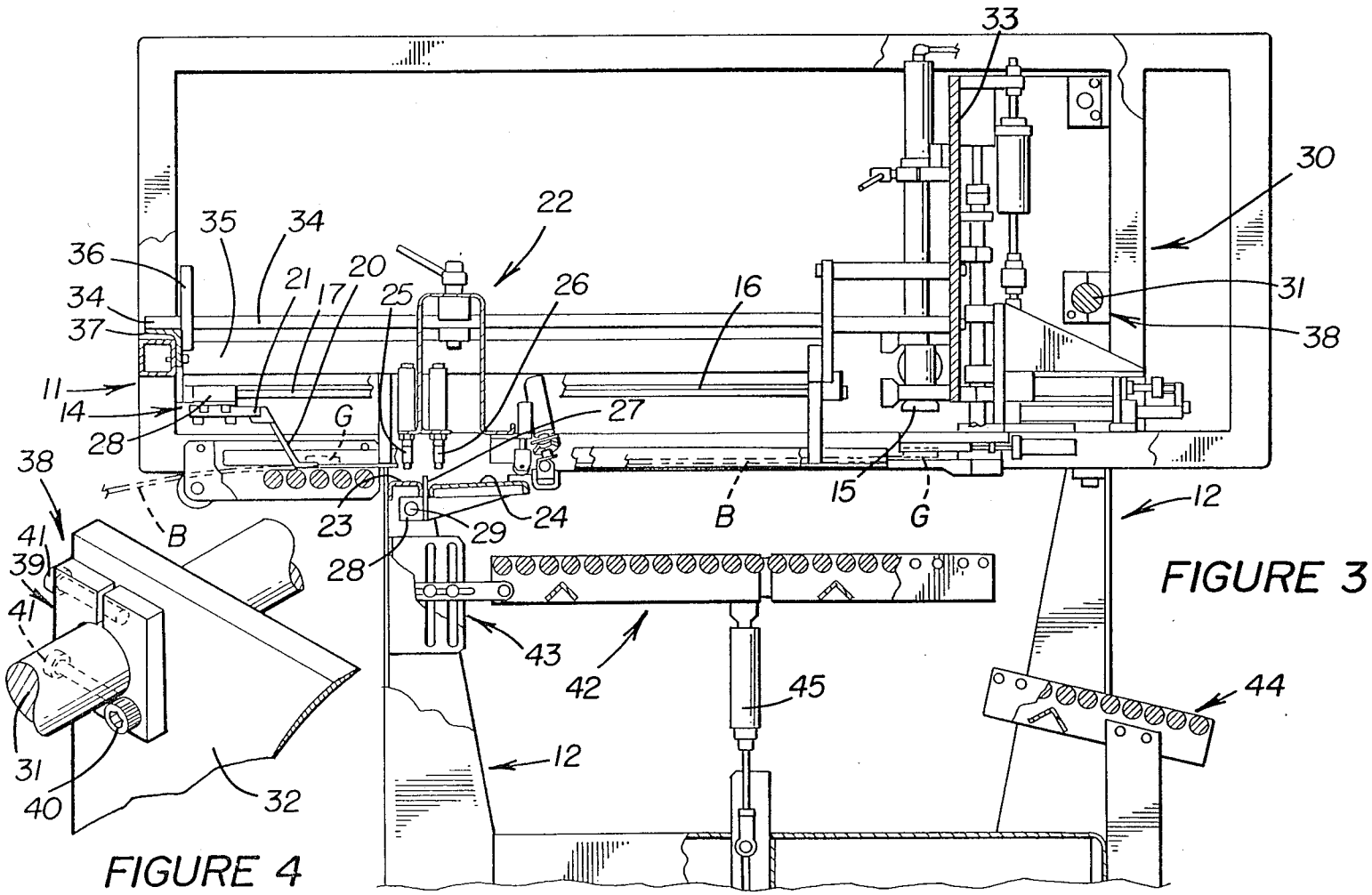
FIG. 3 is a partially sectioned elevational view of the machine, generally taken in the direction of arrows III—III in FIG. 1.
FIG. 4 is an enlarged isometric view illustrating a clamping assembly for releasably securing the carriage assembly at its adjusted position on the frame.

FIGS. 1–3 illustrate a bag filling machine 10 comprising a main frame 11 mounted on four vertically disposed pedestals 12. The frame of a carriage assembly 13 is mounted on the main frame and has a conveyor 14 mounted thereon for intermittently moving bags B (one shown in phantom lines) along a linear path P in the direction of a central longitudinal axis X of frame As shown in FIG. 3, each bag has a gland G secured thereon to define a fill opening alignable with a fill tube 15 of a filling station of the carriage assembly.

Conveyor 14 is of the type described in applicant's co-pending U.S. patent application Ser. No. 280,710, filed on Dec. 6, 1988 for "Cross-Cutting Apparatus, Conveyor and Method for Bag Filling Machines" which is incorporated by reference herein. In general, the conveyor includes a pair of laterally spaced angle bars 16 defining an open guide track therebetween sized to engage and guide movements of gland G along path P. An actuator 17 is of the type described in applicant's above-referenced application and comprises a tube having a piston (not shown) reciprocally mounted therein. A slider 18 is slidably mounted on a pair of longitudinal spaced rails 19, secured o the frame of carriage assembly 13 to extend in the direction of axis X.

The piston, reciprocally mounted in a tube of actuator 17, has one or more magnets secured thereon to co-act through the tube with magnets secured on slider 18. Selective communication of air pressure to one end of the tube and relief of pressure at the opposite end of the tube, in accordance with the programming of the machine, will function to intermittently move slider 18 along path P. A hook 20 is pivotally mounted at 21 on a forward end of slider 18 to engage a particular gland G and move it along the guide track defined by bars 16 in response to actuation of actuator 17. When the actuator is retracted for the next-following sequence of operations, the hook will freely pivot counterclockwise in FIG. 3 and then drop into its operative position illustrated in this figure for repositioning behind a gland G of a next-following bag B.

FIGS. 1 and 3 further illustrate a cross-cutting station 22, also described in applicant's above-referenced application. In general, the cross-cutting station comprises generally horizontally disposed platens 23 and 2 spaced apart in the direction of path P to define an elongated opening therebetween, extending transversely relative to the path (FIG. 3). When delivered to the cross-cutting station, a connected series of plastic bags B are moved by conveyor 14 and stopped to position a severable parting line between each adjacent pair of bags over the opening defined between platens 23 and 24. For example, in the first stage of actuation of actuator 17, hook 20 will engage gland G and move it rightwardly in FIG. 3 and past platen 24 whereby its bag B becomes the "leading" bag. Air-actuated clamping bars 25 and 26 are then extended to clamp the trailing and leading bags to platens 23 and 24, respectively.

A cutting blade 27 is then moved transversely through the severable parting line between the bags to sever connecting tear webs therebetween and thus sever the bags from each other. Cutting blade 27 is slidably mounted on the tube or housing of an actuator 29, similar in construction to actuator 17. These standard actuators may be of the type manufactured by SMC Numetics, Inc. of Indianapolis, Indiana under Model Number NCY1B15H and NCDYIS15H (SMC Rodless Cylinders Series NCY1), as fully described in applicant's above-referenced application and in U.S. Pat. No. 4,488,477, also incorporated by reference herein.

After the cutting operation, actuator 17 will enter its second stage of actuation to move the leading bag to the filling station. In particular, hook 20 will remain engaged with the gland to move it rightwardly in FIG. 3 to vertically align its fill opening under fill spout 15. After the filled bag has been removed, the opposite end of actuator is pressurized to retract slider 28 and hook 20 to their start positions shown in FIGS. 1 and 3.

Applicant's co-pending U.S. patent application Ser. No. 274,821 filed on Nov. 22, 1988 for "Filling Head With Quick-Change Nozzle," also incorporated by reference herein, describes pertinent details of the filling station and, in particular, fill tube 15. Since details of the filling and cross-cutting stations are not required for a full understanding of this invention, further description thereof is deemed unnecessary.

This invention is primarily directed to an adjustment means 30 for adjustably mounting carriage assembly 13 on frame 11. The adjustment means provides the machine's operator with the capability of selectively moving the carriage assembly, including conveyor 14 and the cross-cutting and filling stations, transversely relative to axis X of the main frame. In this manner, the carriage assembly can be adjusted to reposition path P on the main frame, transversely relative to axis X, to accommodate bags having their fill openings or glands G disposed at varied preset positions on the bags. For example, FIG. 1 illustrates path P coincident with axis X whereas FIG. 2 illustrates adjustment or lateral shifting of carriage assembly 13 and path P, transversely of axis X.

Referring to FIGS. 1, 3 and 4, adjustment means 30 comprises a cylindrical mounting beam 31 secured to opposite side rails of main frame 11 to extend transversely relative to central longitudinal axis X of the frame. A pair of lateral spaced brackets 32 have their distal ends slidably mounted on beam 31. The proximal ends of the brackets ar suitably secured to a transversely disposed mounting plate 33, forming part of the mounting frame of carriage assembly 13.

The mounting plate mounts working components of the filling station, including reciprocal fill tube 15, thereon and is further secured to the distal ends of a pair of outer support bars 34. The distal ends of a pair of inner support beams 35 also have their distal ends secured to mounting plate 33 and have their proximal ends suitably secured to a cross strut positioned adjacent to a support rail 37 of main frame 11, extending transversely relative to axis X. As shown in FIGS. 1 and 3, the proximal ends of support bars 34 extend through cross strut 36 and rest in unattached relationship on the upper surface of support rail 37.

With the above described mounting of the frame assembly of carriage assembly 13 on main frame 11, it can be seen that the sole attachment of the carriage assembly to the frame occurs at the mounting of brackets 32 on mounting beam 31. Thus, when the machine's operator desires to shift the carriage assembly on the frame to reposition path P relative to axis X, he need only push one of the brackets 32 on the mounting beam to simultaneously reposition conveyor 14 and the filling and cross-cutting stations for this purpose. In the preferred embodiment of this invention, a clamping assembly 38 provides attachment means for releasably securing at least one of the brackets 32 to mounting beam 31.

In the illustrated embodiment, the clamping assembly (FIG. 4) comprises a two-piece clamping collar 39 mounted on beam 31 and fastening means for releasably clamping the collar to the beam and to releasably secure the collar to bracket 32. For example, such fastening means may comprise a bolt 40 for securing one of the collar parts to bracket 32 and a pair of vertically spaced bolts 41 for securing the collar parts together. In this embodiment of the clamping assembly, bolt 40 can remain tightened to continuously secure the inner part of the clamping collar to bracket 32. Thus, adjustment of a carriage assembly along mounting beam 31 will only require release and subsequent tightening of bolts 41 to effect such adjustment.

FIG. 3 further illustrates an unloading table 42 having one end adjustably mounted at 43 in a vertical direction on a pedestal 12. The table's opposite end is positioned adjacent to the upstream end of an unloading ramp 44, adapted to unload the fill bags into a carton or the like. The unloading table underlies the filling station to receive the filled bags at all adjusted positions of the carriage assembly on the main frame (having their glands capped, subsequent to the filling operation in a conventional manner). A vertically adjustable air cylinder 45 is adapted to selectively position the downstream end of the unloading table with the upstream end of ramp 44.

I claim:

1. A bag filling machine for conveying bags along a path to a filling station, each of said bags including a fill opening positioned at a present position thereon for having a liquid product dispensed therethrough, said machine comprising a stationary frame disposed on a longitudinal axis thereof, a carriage assembly mounted on said frame, conveyor means mounted on said carriage assembly for moving each of said bags along said path in the direction of said axis, a filling station, including a fill tube aligned with said path, mounted on said carriage assembly for sequentially receiving each of said bags and filling it with said liquid product, and adjustment means adjustably mounting said carriage assembly on said frame for selectively moving said carriage assembly, along with said conveyor means and said filling station, transversely relative to said axis whereby said carriage assembly can be adjusted to accommodate bags having their fill openings disposed at varied preset positions on said bags.

2. The machine of claim 1 wherein said adjustment means comprises a mounting beam secured to said frame and extending transversely relative to said axis and bracket means for slidably mounting said carriage assembly on said mounting beam.

3. The machine of claim 2 wherein said bracket means slidably mounts a first end of said carriage assembly on said mounting beam and said frame comprises a support rail extending transeversely relative to said path and mounting a second end of said carriage assembly thereon.

4. The machine of claim 3 wherein the first end of said carriage assembly is slidably mounteed on said mounting beam and the second end of said carriage assembly is supported in unattached relationship on said support rail.

5. The machine of claim 3 wherein said adjustment means further comprises attachment means for releasably securing said bracket means to said mounting beam.

6. The machine of claim 5 wherein said attachment means comprises a clamping collar mounted on said mounting beam and fastening means for releasably clamping said clamping collar to said mounting beam and for releasably securing said clamping collar to said bracket means.

7. The machine of claim 6 wherein said clamping collar comprises a first part releasably secured to said bracket means by first fastening means and a second part releasably secured to said first part by second fastening means.

8. The machine of claim 3 wherein said bracket means comprises a pair of laterally spaced brackets having their distal ends slidably mounted on said mounting beam and wherein said carriage assembly further comprises a mounting plate extending transversely relative to said axis, having said filling station mounted thereon, and wherein said mounting plate is secured to proximal ends of said brackets.

9. The machine of claim 8 wherein said carriage assembly further comprises a laterally spaced pair of support bars extending in the direction of said axis and having their distal ends secured to said mounting plate and their proximal ends mounted and supported in unattached relationship on said support rail.

10. The machine of claim 9 wherein said carriage assembly further comprises a cross-strut extending transversely relative to said axis and positioned adjacent to said pair of support rail and wherein said support bars extend through said cross-strut.

11. The machine of claim 10 wherein said carriage assembly further comprises a pair of laterally spaced support beams extending in the direction of said axis and having their distal ends secured to said mounting plate and their proximal ends secured to said cross-strut.

12. The machine of claim 1 further comprising a cross-cutting means mounted on said carriage assembly, upstream of said filling station, for severing an adjacent pair of said bags from each other.

13. The machine of claim 12 further comprising unloading table means mounted below said filling station for receiving said bags from said filling station.

* * * * *